US005636382A

United States Patent [19]

Chopko et al.

[11] Patent Number: 5,636,382

[45] Date of Patent: Jun. 10, 1997

[54] PROTECTIVE SYSTEMS FOR SENSITIVE SKIN

[75] Inventors: David A. Chopko, Kennett Square, Pa.; Brent I. Goodwin, Elkton, Md.; Francis J. Masley, Wilmington, Del.; Jaclyn M. Woll, Flagstaff, Ariz.

[73] Assignee: W. L. Gore & Associates, Inc., Newark, Del.

[21] Appl. No.: 340,096

[22] Filed: Nov. 15, 1994

[51] Int. Cl.[6] ..... A41D 13/10

[52] U.S. Cl. ..... 2/167; 2/161.7; 2/164; 2/168

[58] Field of Search ..... 2/167, 168, 164, 2/169, 161.7, 159, 161.6, 901

[56] References Cited

U.S. PATENT DOCUMENTS

| | | | |
|---|---|---|---|
| 3,879,764 | 4/1975 | Weber-Liel | 2/167 |
| 3,945,049 | 3/1976 | Barlow | 2/167 |
| 4,194,041 | 3/1980 | Gore et al. | 2/167 |
| 4,430,759 | 2/1984 | Jackrel | 2/167 |
| 4,660,228 | 4/1987 | Ogawa et al. | 2/167 |
| 4,696,065 | 9/1987 | Elenteny | 2/168 |
| 4,932,078 | 6/1990 | Jones et al. | 2/70 |
| 5,003,638 | 4/1991 | Miyake et al. | 2/167 |
| 5,020,161 | 6/1991 | Lewis, Jr. et al. | 2/164 |
| 5,036,551 | 8/1991 | Dailey et al. | 2/167 |
| 5,088,125 | 2/1992 | Ansel et al. | 2/168 |
| 5,123,119 | 6/1992 | Dube | 2/168 |
| 5,133,090 | 7/1992 | Modak et al. | 2/167 |
| 5,349,705 | 9/1994 | Ragan | 2/161.6 |
| 5,483,703 | 1/1996 | Wiliams | 2/167 |

FOREIGN PATENT DOCUMENTS

| | | |
|---|---|---|
| 0410292 | 1/1991 | European Pat. Off. . |
| 2264632 | 9/1993 | United Kingdom . |

OTHER PUBLICATIONS

Letter: Feb. 22, 1993 from W. L. Gore & Associates to Food and Drug Administration, "510(k) Submission: Procel™ Dermaliner Glove".

Letter: Feb. 14, 1994 from Department of Health & Human Services to W. L. Gore & Associates, Inc., Mr. Larry Kovach, K931094, Procel™ Dermaliner Glove.

Donald H. Beezhold; David A. Kostyal; Jeffrey Wiseman, MD, "The Transfer of Protein Allergens From Latex Gloves," Mar. 1994, vol. 59, No. 3 Aorn Journal, pp. 605–613.

Mark E. Bubak, M.D., Charles E. Reed, M.D., Anthony F. Fransway, M.D., John W. Yunginer, M.D., Richard T. Jones, B.S., Carol A. Carlson, M.D., Loren W. Hunt, M.D., "Subspecialty Clinics: Allergic Diseases", Allergic Reactions to Latex Among Health–Care Workers, Mayo Clin. Proc., Nov. 1992, vol. 67, pp. 1075–1079.

Margaret Furay Fay, RN, "Hand Dermatitis", Aorn Journal, Sep. 1991, vol. 54, No. 3,. pp. 451–467.

Ernesto Gonzalez, "Latex Hypersensitivity: A New and Unexpected Problem", Hospital Practice, Feb. 15, 1992, pp. 137–151.

Angelika Heese, MD, Jutta Hintzenstern, MD, Klaus–Peter Peters, MD, Hans Uwe Koch, PhD, and Otto Paul Hornstein, MD, "Allergic and irritant reactions to rubber gloves in medical health services," Journal of the American Academy of Dermatology, vol. 25, No. 5, Part 1, Nov. 1991, pp. 831–839.

Noel R. Rose, Everly Conway de Macario, John L. Fabey, Herman Friedman, Gerald M. Penn, "Manual of Clinical Laboratory Immunology," fourth edition, American Society for Microbiology, Washington, D.C., Chapter 101.

*Primary Examiner*—Amy B. Vanatta
*Attorney, Agent, or Firm*—Gary A. Samuels, Esquire

[57] ABSTRACT

A protective glove system having at least two components including a waterproof and water vapor permeable inner glove component that provides a barrier against allergens and an outer glove component that is liquidproof. A method of using the glove system is also provided. Protective shoe systems, body suits, and headgear systems are also provided.

18 Claims, 4 Drawing Sheets

PROTECTIVE SYSTEMS FOR SENSITIVE SKIN

FIELD OF THE INVENTION

This invention relates to a protective system including a protective glove system for use as a barrier against allergen exposure and improvements thereof for managing allergy related skin reactions. The system may be used in any environment where protective devices are required to protect the skin from unwanted exposure of contaminants and includes use both in the household and work environment, particularly in health care facilities.

BACKGROUND OF THE INVENTION

The use of protective clothing has become extremely commonplace as our environment has become more threatening, with increasing risks of exposure to chemical, biological, and radiological hazards and to thermal and mechanical trauma. Protective gloves, in particular, are used in both household and occupational settings. In many cases, the wearing of gloves is required for employment. In most instances, glove use is prescribed when there is a readily identifiable risk, such as extremes of temperature, sharp or rough surfaces, or chemicals known to cause injury to the skin. Some manufacturing environments also utilize gloves to prevent contamination of products by oils from the hand. In the health care setting, gloves are used to provide a barrier to microorganisms, protecting both the patient and the health care provider from transmission of infection or disease. Use of gloves in the home is most often related to prevention of exposure to liquid during cleaning.

The typical protective glove is completely occlusive. These gloves, made of rubber, vinyl or other polymers, are waterproof and may also provide a barrier to chemicals and/or microorganisms. Some gloves may include insulation for thermal protection. Fabric gloves may protect the wearer from cuts and abrasion, but not to liquids or microorganisms. Gloves for specific applications may combine these features. Ideally, these gloves provide the necessary protection while permitting sufficient hand dexterity and tactility to perform required functions.

A percentage of the general population has allergies or sensitivities that increase the need for protection from conditions that would not be a problem for most individuals. For example, an office worker may be sensitive to chemicals present in copy machine toner, creating an unexpected requirement for occupational glove use. Some of these allergens and sensitizers are actually present in the garments used to protect the skin. Many rubber products, including gloves, work boots and aprons, contain processing chemicals that are documented sensitizers. Exposures to these chemicals cause skin disorders broadly termed allergic or contact dermatitis.

Furthermore, individuals with sensitivities to specific chemicals have generally sensitive skin and require protection from adverse conditions of any type, including extremes of temperature and/or moisture level. These conditions may require treatment with topical medications. The typical occlusive glove causes a buildup of heat and moisture against the skin which can trigger a reaction and may prevent proper function of topical medications. Fabric gloves, while preventing this buildup, may not offer adequate protection or sufficient covering over medications.

The use of latex gloves in the health care setting is of particular concern. Gloves made from natural rubber latex are considered the best protection from potentially dangerous microorganisms. Latex gloves are also very thin, conform to the hand and are inexpensive. However, in addition to containing the common rubber additives that are sensitizers, latex gloves contain a protein that is a cause of allergic reaction. Medical evidence suggests that not only do some latex glove wearers become more sensitive with continuing exposure to the glove, but over time, the response converts from a skin reaction causing dermatitis to a systemic reaction that may cause respiratory distress and, in extreme cases, anaphylactic shock. As the use of latex gloves increases due to the enhanced need for protection from microorganisms, so does the incidence of skin irritation and systemic allergic reaction. For individuals with latex sensitivity, there is a potential dilemma between sufficient barrier protection, their health, and if the reaction becomes severe, their livelihood.

In addition to wearing protective gloves, health care workers are now often required to change their gloves between patient contacts and wash their hands between each change. It is not unusual for a hospital worker to change gloves and wash hands between ten and fifty times each day. For individuals with sensitive skin, the constant exposure to water and cleansers can cause skin reactions and prevent the use of topical medications.

There has been considerable effort in developing improved gloves, each addressing one or more aspects of the situation described above. A number of latex and synthetic gloves are being manufactured which eliminate or reduce the latex protein and/or chemical irritants. None of these remove the need to change the gloves and wash the hands or reduce moisture buildup. Also, many of the synthetic gloves are considerably more expensive than the standard latex glove and have inferior fit and tactility compared to latex. U.S. Pat. No. 4,696,065 relates to a glove that has several disposable layers which allow the user to peel away and discard the outermost layer after each use without removing the glove. While this invention provides for a mechanism to avoid removing the gloves and washing the hands, it does not address the buildup of heat or moisture and the bulky, multilayer construction would not provide the fit and dexterity of latex. In addition, a cut or needlestick would require disposing of the glove regardless of how many usable layers remained.

In order to meet the requirement for reduction of moisture against the skin, the protective garment must be moisture vapor permeable. For example, U.S. Pat. No. 4,660,228 describes a glove comprising two elastic sheet materials consisting essentially of a thin polyurethane non-woven fabric that is air and moisture vapor permeable. Such a construction is unlikely to provide the necessary barrier protection or be sufficiently easy to clean. Similarly, U.S. Pat. Nos. 4,783,857 and 4,670,330 describe gloves made of a continuous film of hydrophilic polymers. U.S. Pat. No. 5,036,551, herein incorporated by reference, describes a moisture permeable glove made of a laminate of an elastic nonwoven fabric, hydrophilic layer and microporous polymeric membrane. Two laminate sheets are sealed together in the form of a glove. While each invention offers some advantages, none offers the barrier properties and fit of latex. The hydrophilic polymer gloves swell and weaken with exposure to water. The laminate glove is not sufficiently elastic to conform to the hand and the construction makes a continuous liquid and microorganism barrier unlikely.

A different approach to solving this problem is to provide a two component system consisting of a moisture permeable inner liner and an outer protective glove. U.S. Pat. No. 5,043,209 relates to a clothing liner particularly for gloves, which permits passage of sweat vapor in one direction while preventing liquid from returning in the other direction by providing an inner layer that is permeable to vapor but not to liquid and transfers moisture to an absorptive outer layer. While such a liner will effectively remove moisture from the skin, the outer layer would be bulky and become heavy with collected moisture. Also, the absorptive nature of the outer layer would trap contamination and could not be readily cleaned.

There is a need for an inexpensive reusable glove system that provides additional protection to the user against allergens and the development of dermal sensitivity generated by conventional gloves. There is also a need for a glove system that provides fit and barrier properties, reduces buildup of heat and moisture against the skin, allows for contamination control without the need for constant hand washing, may be used with topical medication, and is cost effective.

SUMMARY OF THE INVENTION

A protective glove system is provided having at least two components including an inner component that is waterproof, moisture vapor permeable and reduces exposure to allergens and an outer component comprising a liquid-proof material. A method of using the glove system and other protective systems to a garment and hat are also provided.

DETAILED DESCRIPTION OF THE INVENTION

A protective glove system is provided that comprises at least two components; namely, an inner glove component and an outer occlusive glove component.

The inner component is made of a waterproof, moisture vapor permeable material which reduces exposure to allergens and irritants from contacting the skin. These allergens and irritants may come from the outside environment as well as from the outer glove component itself. Simultaneously, this inner component likewise prevents any perspiration from building up against the skin due to its breathability. This inner component can be disinfected while being worn and may be reused with multiple changes of the outer component.

The outer component includes a waterproof glove that may be changed as required due to destruction, contamination, or established work rules. This outer and primary component also provides additional protection against exposure to allergens or irritants in the environment.

Figure 1:
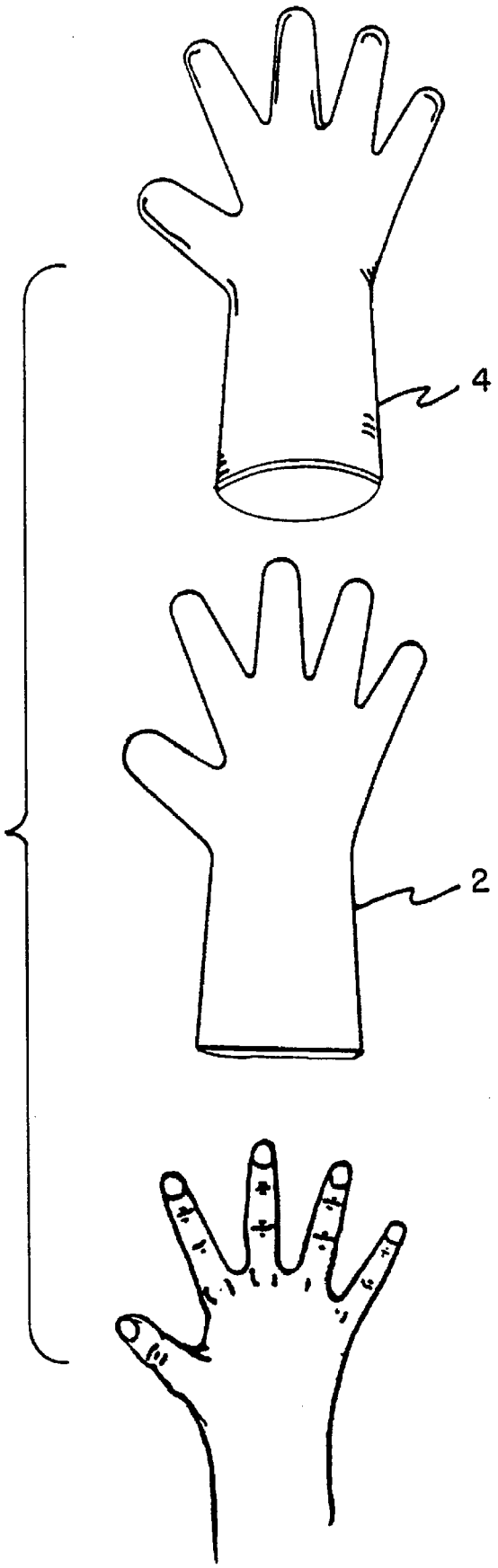
FIG. 1 is a schematic exploded perspective of the glove system.

The invention is best understood by reference to the accompanying drawings. FIG. 1 is a schematic exploded perspective of the glove system wherein an inner glove 2 is first placed onto the bare hand and an outer occlusive glove 4 is then placed over the inner glove 2.

The inner glove component 2 must be strong and durable yet thin, have a high moisture vapor transmission rate and have an external surface that may be readily disinfected by alcohol or biocidal aqueous solutions. The inner glove component 2 should not readily absorb moisture during wear or cleaning and should be comfortable to wear against the skin. Various technologies can be employed to create the inner glove component 2. Suitable materials include single layer films or multilayer laminates containing microporous materials having microstructures of void spaces interconnected by polymeric materials and polymeric materials that are moisture vapor permeable but have not been rendered microporous. Such materials include, for example, polyurethanes, copolyether esters, polyacrylates, polypropylene, polytetraflouroethylene, polyamides, copolyether amides. The polymer materials may be formed into gloves by a dipping technique to form a three dimensional structure; gloves may also be constructed from sheets of film or laminate.

Figure 2:
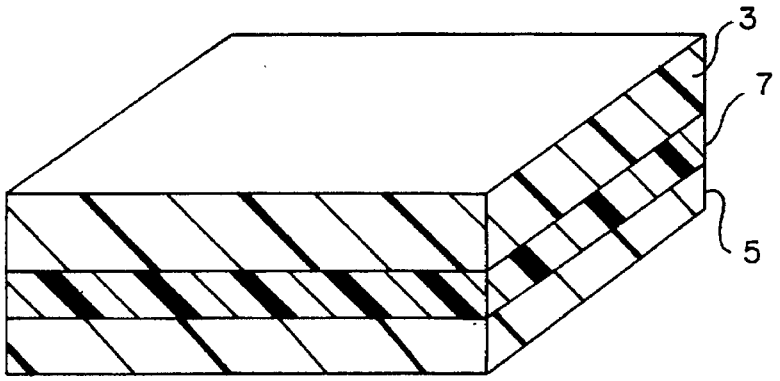
FIG. 2 is a cross section of a material suitable for use as the inner glove component.

In a preferred embodiment, the inner component is produced from a two layer laminate 1 as shown in cross-section in FIG. 2. The inner layer 3 of the laminate 1 does not readily absorb or retain moisture and provides a soft and comfortable surface that does not stick to the skin. Such materials include nonwoven polymeric materials and woven or knitted natural or synthetic fibers. Suitable nonwoven materials include, for example, polyamides, polyacrylates, polyesters, polypropylenes and polyethylenes. Other suitable fabrics include knits or woven made of wool, silk, nylon, and acrylic. A most preferred nonwoven material is a polyetherester, Demique® fabric commercially available from Kimberly Clark of Wisconsin.

The outer layer 5 of the laminate provides a waterproof and moisture vapor permeable barrier to the inner glove component. Suitable materials include the moisture vapor permeable polymers listed above. The most preferred material suitable for this layer includes a film of expanded polytetrafiouroethylene (ePTFE). Such material is described in U.S. Pat. Nos. 3,953,566 and 4,187,390. This film may be coated with a hydrophilic agent as described in U.S. Pat. No. 4,194,041. These materials are available from W. L. Gore & Associates, Inc. of Newark, Del. under the trademark GORE-TEX. EPTFE does not swell or weaken when exposed to water, is thin and strong and provides a cleanable surface.

The outer layer 5 is laminated to the inner layer 3 by conventional laminating techniques to form a material suitable for constructing the inner component of the glove assembly. In a particularly preferred embodiment, an uncoated ePTFE film 5 is laminated to the polyetherester material 3 described above via a continuous layer of hydrophilic, moisture vapor permeable bonding agent 7 as shown in FIG. 2. The bonding agent 7 provides a continuous connection between the two layers. "Continuous" is hereby defined as unbroken so that the bonding agent provides an unbroken means of attachment between the outer layer 5 and the inner layer 3. The bonding agent also provides additional blockage of the transfer of bacteria and allergens to the wearer's skin. Bonding agents 7 include but are not limited to polyurethanes or copolyetheresters. A preferred polymer composition is described in U.S. Pat. No. 4,532,316.

In the preferred embodiment, inner glove component 2 is constructed from the laminate 1 described above by placing two sheets of laminate facing each other so that the inner layers 3 are placed face to face. A form of a glove is then punched out or cut and the two faces are adhered to each other by application of heat or any other means of sealing so that seams are formed. The resulting seam provides a continuous polymeric attachment without the creation of holes thereby preventing entry of any unwanted contamination or allergens. Sewing of seams is not within the scope of the methods due to the resulting holes in the material.

Referring again to FIG. 1, the outer glove component 4 may comprise any liquidproof glove that provides the required reduction of exposure to potentially dangerous microorganisms. The preferred glove is made of natural rubber latex, but gloves made of synthetic rubbers, polymers or vinyl may also be utilized. Suitable outer glove components are commercially available from Becton Dickinson of Franklin, N.J., Baxter Healthcare Corporation of Valencia, Calif. and Best Manufacturing Co., of Menlo, Ga.

In use, the inner glove 2 is first donned and may be used continuously thereafter. The outer glove component 4 is then applied. The resulting glove system should be snug but not constricting and should provide comfort and tactility. As the system is worn, moisture from the hand may diffuse through the inner glove and be collected under the outer glove. The outer glove 4 should be changed whenever required according to workplace rules or when desired for convenience or comfort. The inner glove component 2 need not be removed and, if required, it may be washed with alcohol or a cool biocidal solution. In situations not requiring an outer glove 4, the inner glove component 2 may be worn alone for extended periods for additional skin protection.

Moreover, users of the glove system may treat their hands with a skin cream or medication prior to donning the inner glove component. The inner component 2 protects the skin treatment by preventing penetration or accumulation of liquids that compromise effectiveness.

Figure 3:
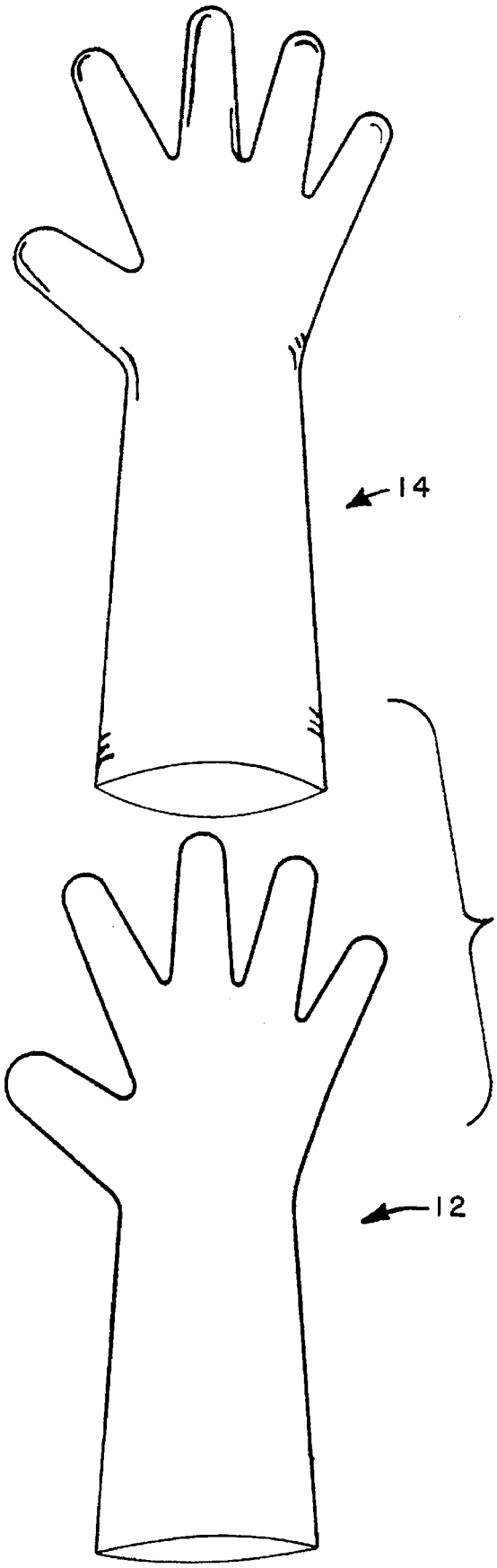
FIG. 3 is a schematic perspective of the gauntlet.

This system may also be incorporated with the use of other protective clothing. FIG. 3 shows a schematic perspective of the inner component 12 being used with a gauntlet 14 having an extended length to protect the arms. In this assembly, the inner component also is provided with an extended arm length, however a standard inner glove component 2 such as that shown in FIG. 1 may also be suitable.

Figure 4:
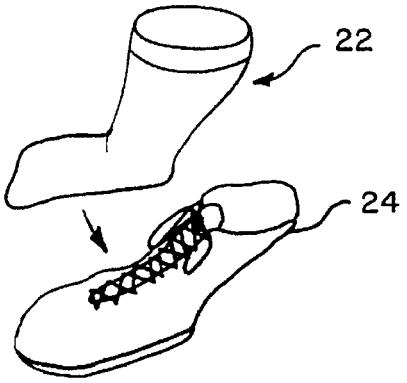
FIG. 4 is a schematic exploded perspective of a shoe system.

Likewise, FIG. 4 shows a schematic perspective of an inner bootie 22 made from the same laminate as described above for use as the inner glove component. For this application, sheets of a laminate are punched or cut into the shape of a sock and then adhered together to form waterproof seams. This bootie 22 may then be utilized either under a sock or directly under a boot or shoe 24.

Figure 5:
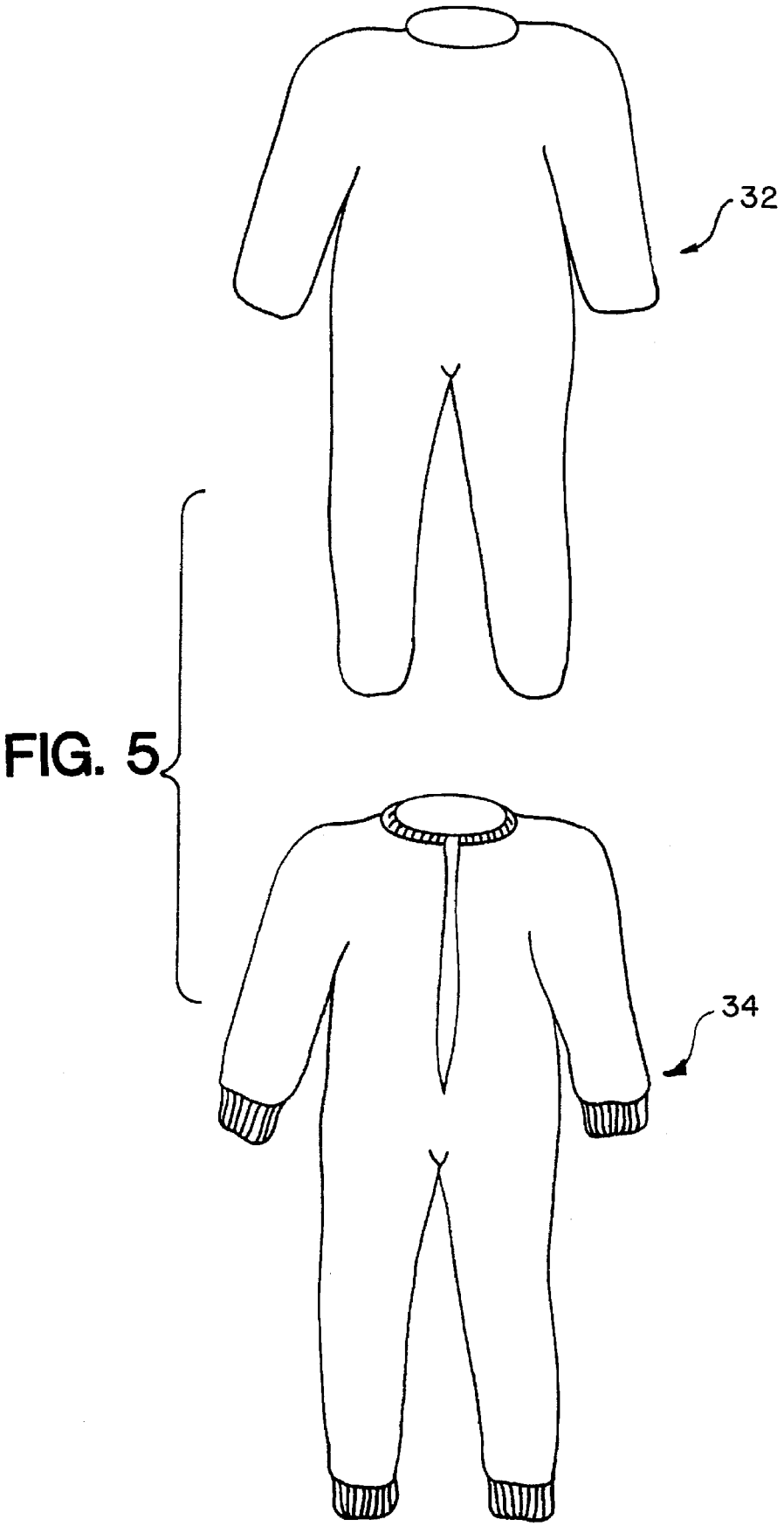
FIG. 5 is a schematic perspective of a body suit.

FIG. 5 shows a schematic perspective of an inner body suit 32 made from the same laminate as described above. For this application, sheets of laminate are cut into a front and back one piece design of a loose fitting body suit. The front and back pieces are placed front to front and then heat bonded or otherwise treated to cause seams to form. Suitable closures include snaps, tabs, velcro interlocking devices and waterproof zipper closures such as that described in Norvell U.S. Pat. No. 5,386,616.

Conventional protective garments 34 such as those commercially available from Lab Safety Supply Co. of Janesville, Wis. may then be donned over the inner suit 32. Alternatively, the workers' street clothes or other clothing may be worn directly over the inner suit 32.

Figure 6:
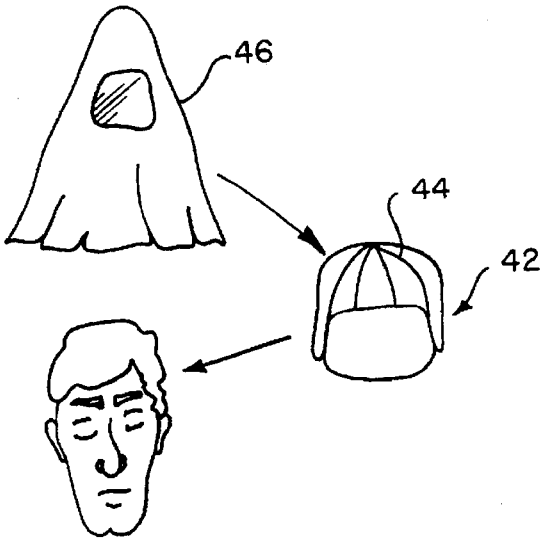
FIG. 6 is a schematic perspective of a headgear system.

FIG. 6 shows a schematic perspective of a headgear liner 42 made from the same laminate as described above. Sheets of laminate are punched or cut into the shape of a fitted cap and adhered together by application of heat or other methods as described above. The cap may extend over part or all of the face with appropriate provisions for openings to see and breathe. The cap may be utilized under a helmet, hood, or completely contained within a headgear system 46.

TESTING METHODS

WATERPROOFNESS

The inner glove was tested for waterproofness by performing a water fill test. Water (500 ml) was carefully poured into an inverted glove. The glove was observed for two minutes, or until water leakage through the glove material or seams was noted. Waterproofness, defined as an absence of leakage during the two minute period, was determined.

BREATHABILITY

Moisture vapor transmission rate (MVTR) was measured according to the method described in U.S. Pat. No. 4,862,730 to Crosby. In this method, the laminate used for the inner glove compound was placed onto a waterproof, moisture vapor permeable membrane supported on a temperature controlled water bath. A cup containing saturated sodium chloride solution was inverted and placed on the sample. Moisture vapor permeated from the water bath, through the sample and through the mouth of the inverted cup. MVTR (expressed in grams of water per square meter of sample per 24 hours) was determined by measuring the amount of water absorbed by the cup during a given time interval and adjusted for the area of the mouth of the cup. The temperature of the water bath was 23° C. and the ambient air temperature and relative humidity were controlled at 23° C. and 50% respectively. Breathability was defined as having a minimum MVTR of 2000 $g/m^2$-24 hr.

ALLERGEN BARRIER

Allergic reaction to latex gloves is caused by protein molecules found in raw latex. Tests to evaluate the barrier properties of the inner glove component were conducted in accordance with the following procedures.

A finger portion of a glove was filled with buffered saline test solution and sealed with a tubing clip. The test sample was then suspended in a challenge solution containing concentrated ammoniated latex and allowed to equilibrate for 24 hours. Control experiments were performed by inserting a needle through the glove material and creating a passageway for challenge solution to mix with the test solution. Concentrations of latex allergen in the challenge and test solutions were determined using radioallergosorbent tests. An effective barrier, defined as allowing no transfer of allergen to the test solution, was determined.

EXAMPLE

A glove component system was developed and tested. The outer glove component was made of natural rubber latex. The inner glove component was constructed from a two layer laminate of expanded polytetrafluoroethylene and a polyether-polyester nonwoven fabric made in accordance with the teachings of U.S. Pat. No. 5,036,551. Lamination was achieved utilizing a continuous layer of polyurethane adhesive. Shapes of a glove were cut from the laminate and heat sealed together to form an inner glove component. Both the inner and outer components were tested for waterproofness and found to be waterproof. The MVTR of the inner component was found to be 8000 $g/m^2$-24 hr. The inner component was also tested for its suitability as an allergen barrier. The concentration of the latex allergen challenge solution was 35, 100 allergy units (AU) per mi. No allergen was detected in the test solution. The latex allergen concentrations of the challenge and test solutions in the control experiment were 26,900 and 582 AU/ml respectively.

We claim:

1. A protective glove system comprising at least two components including:

(a) a waterproof and moisture vapor permeable inner glove component that reduces exposure to allergens and irritants and has a moisture vapor transmission rate of at least 2000 $g/m^2$-/24 hrs.; and (b) a separate, removable liquid-proof occlusive outer glove component positioned over the inner glove component.

2. A protective glove system according to claim 1 wherein the outer glove component is selected from the group including latex rubber, synthetic rubber, vinyl, and elastomeric protective barrier gloves.

3. A protective glove system according to claim 1 wherein the outer component is a reusable glove.

4. A protective glove system according to claim 1 wherein the inner glove component is comprised of a film selected from the group including polyurethane, copolyether esters, polyacrylates, polypropylene, polytetrafluoroethylene, polyamide, copolyether, amides.

5. A protective glove system according to claim 1 wherein the inner glove component is comprised of a film of polymeric materials that have not been rendered microporous.

6. A protective glove system according to claim 1 wherein the inner glove component is comprised of a laminate including a layer of nonabsorbent fabric material bonded to a layer of waterproof and water vapor permeable material.

7. A protective glove system according to claim 6 wherein the layer of nonabsorbent fabric material is a non-woven polymer fabric.

8. A protective glove system according to claim 6 wherein the layer of nonabsorbent fabric is selected from the group including woven materials and knitted materials.

9. A protective glove system according to claim 6 wherein the layer of waterproof and water vapor permeable material is a film selected from the group including polyurethane, copolyether esters, polyacrylates, polypropylene, polytetrafluoroethylene, polyamide, copolyether, amides.

10. A protective glove system according to claim 6 wherein the layer of waterproof and water vapor permeable material is a film of expanded porous polytetrafluoroethylene.

11. A protective glove system according to claim 6 wherein the layer of waterproof and water vapor permeable material is a film of a polymeric material that has not been rendered microporous.

12. A protective glove system according to claim 6 wherein a continuous layer of hydrophilic polymer is used to bond the layer of nonabsorbent fabric to the layer of waterproof and water vapor permeable material.

13. A protective glove system according to claim 1 wherein the inner glove component and outer glove component are provided with extended arm regions so as to form gauntlets.

14. A protective glove system comprising at least two components including:

(a) a waterproof and moisture vapor permeable inner glove comprised of a film of expanded porous polytetrafluoroethylene that reduces exposure to allergens and irritants; and (b) a separate, removable liquid-proof occlusive outer glove component positioned over the inner glove component.

15. A method of using a glove component system comprising the steps of first, donning an inner glove comprising a waterproof, moisture vapor permeable inner glove component having an MVTR of at least 2000 and second, donning an outer liquidproof glove comprising a liquidproof material over the first glove component.

16. A method of using a glove component system according to claim 15 further comprising the step of applying a topical treatment to a hand before donning the inner glove component.

17. A method of using a glove component system according to claim 15 further comprising the step of removing the outer glove and disinfecting the inner glove component with a solution selected from the group including alcohols and biocides.

18. A protective system for protecting a wearer of the system against penetration by allergens which comprises a two component system including:

(a) a waterproof and moisture vapor permeable inner glove component that reduces exposure to allergens and irritants and has a moisture vapor transmission rate of at least 2000 $g/m^2$/24 hrs.; and (b) a separate, removable liquid-proof occlusive outer glove component positioned over the inner glove component.

* * * * *